United States Patent [19]

Adler

[11] 4,222,573

[45] Sep. 16, 1980

[54] BOOMERANG

[76] Inventor: Alan J. Adler, 752 La Para Ave., Palo Alto, Calif. 94306

[21] Appl. No.: 33,470

[22] Filed: Apr. 26, 1979

[51] Int. Cl.³ ..... A63B 65/08
[52] U.S. Cl. ..... 273/426
[58] Field of Search ..... 273/106 B, 106 D, 106 R, 273/106.5 A

[56] References Cited

U.S. PATENT DOCUMENTS

| | | | |
|---|---|---|---|
| 692,608 | 2/1902 | Bristow | 273/106 D |
| 2,035,629 | 3/1936 | Wing | 273/106 D |
| 2,640,699 | 6/1953 | Garbo | 273/106 B |
| 2,972,481 | 2/1961 | Shapiro | 273/106 D |
| 3,467,385 | 9/1969 | Liston | 273/106 D |
| 3,801,102 | 4/1974 | Lohr et al. | 273/106.5 A |

*Primary Examiner*—Paul E. Shapiro
*Attorney, Agent, or Firm*—Claude A. S. Hamrick

[57] ABSTRACT

A boomerang comprising a plurality of wings with an internal plastic armature and a soft outer covering.

7 Claims, 8 Drawing Figures

(SEC. A-A)

BOOMERANG

BACKGROUND OF THE INVENTION

Most prior boomerangs have been monolythically constructed of a relatively rigid material such as wood, metal or plastic. Although incidents of injury resulting from these rigid boomerangs are rare, there is a current desire on the part of both parents and toy manufacturers to make toys safer. Two ways to make a boomerang safer are to reduce its weight and rigidity. A combination of both is particularly desirable. Unfortunately boomerangs constructed monolythically from soft, resilient materials do not posses sufficient stiffness to maintain proper aerodynamic shape during flight.

Liston, U.S. Pat. No. 3,565,434, described boomerangs which were constructed with an internal wire framework covered by an outer material which was lighter in weight and less rigid. Liston stressed the fact that the framework was deformable, thus permitting adjustment of the boomerang's flight characteristics.

The present inventor has constructed several boomerangs using Liston's method and found that a metal wire framework has several limitations which are listed below:

a. If maleable metal wire is used (as suggested by Liston) it has a tendency to deform upon impact and spoil the characteristics of subsequent flights unless the boomerangs is re-formed. This re-forming is often beyond the skill of a child.

b. If the framework is made from hardened metal wire (such as spring steel) adjustment becomes quite difficult, especially when the outer covering is made from a soft material. Furthermore, hardened wire is more susceptable to break and leave a sharp edge which can protrude through the outer covering.

c. When the outer covering is made from very soft resilient materials, such as polyethylene foam or polyurethane foam, the wire framework does not provide adequate support for the broader areas of the boomerang-unless the framework contains many wire elements, which would be excessively heavy and costly to manufacture.

d. A wire framework tends to concentrate impact loads in too small an area. This leads to local material failure in the outer covering.

SUMMARY OF THE PRESENT INVENTION

An object of the present invention is to provide a safe boomerang which overcomes the disadvantages of the prior art.

Briefly, the preferred embodiment consists of a boomerang containing an internal, relatively stiff, plastic armature which is covered by a soft resilient material. This plastic armature does not have any of the disadvantages of the previously described metal wire framework.

IN THE DRAWINGS

FIGS. 5*a–d* illustrate a method of forming the wigtips of the internal plastic armature to better absorb impact without damaging the outer covering.

DETAILED DESCRIPTION OF THE PREFERRED EMBODIMENTS OF THE PRESENT INVENTION

Figure 1:
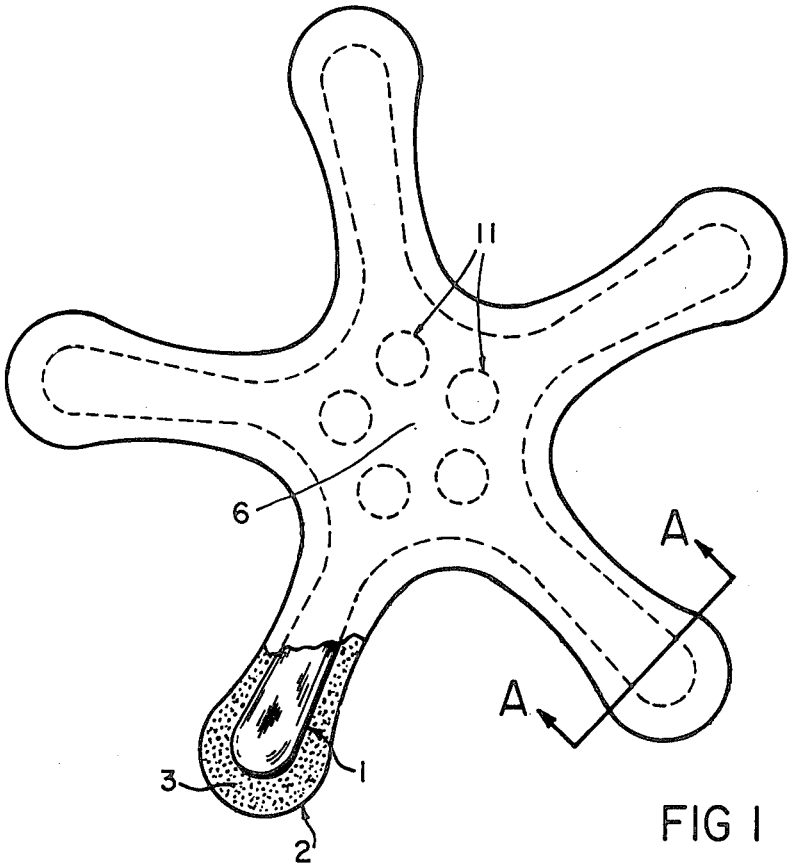
FIG. 1 is a top view of the invention with a partial cutaway to illustrate the internal plastic armature.

FIG. 1 is a top view of the boomerang illustrating the internal plastic armature 1 and the soft outer covering 2. Although a five-winged boomerang is depicted it is obvious that this method of construction is applicable to boomerangs with any number of wings.

Figure 2:
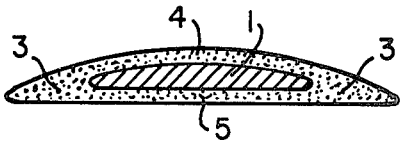
FIG. 2 is a cross-section of one wing of the invention.

FIG. 2 is a cross-section of one wing of the boomerang. Note that the wing edges 3 are unsupported and free to collapse and provide a cushioning effect upon impact. The upper surface 4 and the lower surface 5 of the covering can be thinner than the edges because less cushioning is required in these areas due to the fact that the velocity of the boomerang is always low in directions normal to its plane.

Returning to FIG. 1, note that the planform perimeter of the armature 1 follows a line which is generally equidistant from the perimeter line of the outer covering. The exact distance between these two perimeters can vary to achieve changes in weight distribution or the amount of cushioning but the important thing is that the armature is of generaly planar configuration and is well suited to supporting the broad areas of the soft outer covering, such as the central area 6.

The armature may be economically molded from any of a variety of thermoplastic of thermosetting polymers including (but not limited to); acrylonitrile-butadienestyrene (ABS), nylon, polypropylene, polycarbonate, or polyester. Such materials posess excellent shock absorbing properties and the ability to absorb impacts without permanent deformation. This allows the boomerang to sustain impacts without the necessity to reform the wings.

If the armature is made from ABS plastic, the wings of the boomerang may (if desired) be deliberatly formed (twisted or bent) in order to adjust the flight characteristics in the field. Despite its adjustability, the ABS armature will not be permanently deformed by normal impacts. This is due to the broad elastic range of this material as compared to metal.

The choice of the exact polymer for the armature may be partially influenced by the temperature of the process for applying the soft outer covering. If a high temperature process is used the armature polymer must be capable of maintaining its shape during this process. Some of the higher temperature thermoplastic and thermosetting polymers are quite satisfactory in this regard.

FIG. 1 also shows perforations 11 in the armature. These perforations may be desirable in the broad areas of the boomerang, such as the center 6, because they permit a direct bond between the upper and lower surfaces of the outer covering.

The soft outer covering may be fabricated from any of a variety of resilient materials including (but not limited to) rubber, polyurethane foam, or polyethylene foam.

Figure 3:
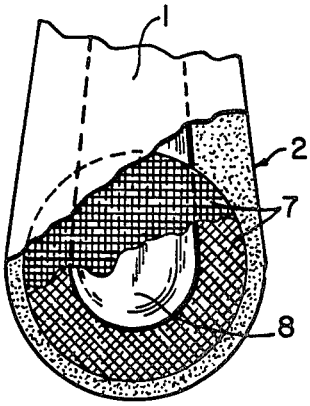
FIG. 3 illustrates a method of reinforcing the wingtips with internal pads.

FIG. 3 illustrates a method of reinforcing the tips of the boomerang with internal pads 7 which overlap the tips 8 of the armature. These pads serve to distribute the pinching load on the soft covering when the boomerang impacts against a hard surface. The pads may be constructed of a flexible material which is stronger than the outer covering but not as rigid as the armature. Examples of such materials include textiles, rubbers and thermoplastic elastomers. If an openweave textile pad is used it forms a composite with the material of the outer covering and is particularly tear resistant.

Figure 4:
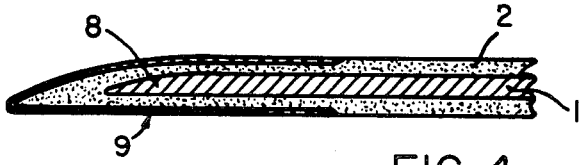
FIG. 4 illustrates an alternative method of reinforcing the wingtips with external boots.

An alternative method of tip reinforcement is shown in FIG. 4 which is a cross-section of the wingtip parallel to its span. Note that the wingtip is covered by an outer boot 9. This boot may be constructed from rubber or a thermoplastic elastomer.

Figure 5A:
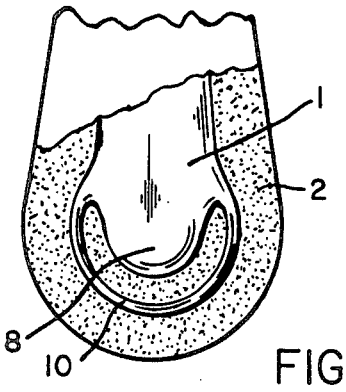
Figure 5B:
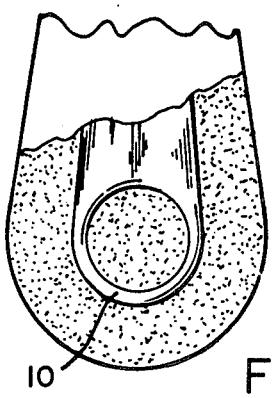
Figure 5C:
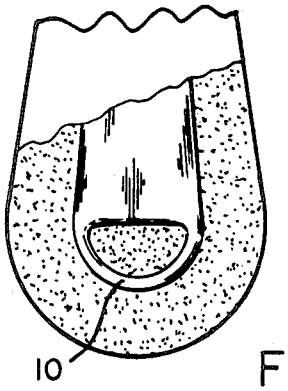
Figure 5D:
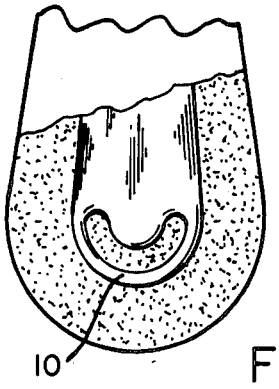

FIG. 5*a*. illustrates still another method of tip protection. Here the armature 1 has an added rim 10 which is spaced away from the main body of the tip 8. Upon impact this rim, which is quite flexible, deflects and absorbs the impact energy without applying pinching loads to the soft outer covering. Although this rim might appear similar to a metal wire framework, its modulus of elasticity is only one one-hundredth that of steel—thus it can easily deflect without imparting excessive loads to the outer covering. FIGS. 5*b*., 5*c*, and 5*d* illustrate alternative forms of the same rim 10.

It is, of course, possible to employ combinations of the tip protections illustrated in FIGS. 3, 4 and 5 in order to provide extra protection.

While in the foregoing specification embodiments of the invention have been set forth in considerable detail for the purpose of making a complete disclosure thereof, it will be apparent to those skilled in the art that numerous changes may be made in such details without departing from the spirit and principal of the invention.

I claim:

1. A boomerang of generally planar configuration comprising:

a body having a central area and a plurality of wings extending outwardly therefrom, and including an internal plastic armature and a soft outer covering, said internal armature being of generally planar configuration and disposed so as to provide support for said soft outer covering, said body further including internal reinforcing pads in the tips of said wings, said pads being of generally planar configuration and positioned such that the planes thereof are parallel to the plane of said body and overlap the tips of said internal armature so as to cushion the impact resulting from a collision between said boomerang and a hard surface.

2. A boomerang as recited in claim 1 wherein said internal armature is described by a planform perimeter following a path which is inside of and generally equidistant from the planform perimeter of the outer covering.

3. A boomerang as recited in claim 1 wherein said internal armature has at least one perforation, normal to its plane, allowing a direct bond between the upper and lower surfaces of said soft outer covering.

4. A boomerang as recited in claim 1 wherein said soft outer covering is comprised of a resilient material.

5. A boomerang as recited in claim 4 wherein said resilient material is cellular.

6. A boomerang as recited in claim 1 having external flexible boots covering the wingtips in order to protect said wingtips from damage due to impacts with hard surfaces.

7. A boomerang of generally planar configuration comprising:

a body having a central area and a plurality of wings extending outwardly therefrom, and including an internal plastic armature and a soft outer covering, said internal armature being of generally planar configuration and disposed so as to provide support for said soft outer covering, said internal armature having wing segments extending along said wings, with each said segment including a rim having a central portion spaced apart from distal end of the segment and end portions jioning the segment in the vicinity of the outer extremities of the leading and trailing edges thereof, whereby said rim readily deflects and absorbs the impact of a collision between the tip of said boomerang and a hard surface.

* * * * *